US008752975B2

(12) United States Patent
Rubino

(10) Patent No.: US 8,752,975 B2
(45) Date of Patent: Jun. 17, 2014

(54) MULTI-FUNCTION TELESCOPIC FLASHLIGHT WITH UNIVERSALLY-MOUNTED PIVOTAL MIRROR

(76) Inventor: Michael Rubino, Chicago, IL (US)

( * ) Notice: Subject to any disclaimer, the term of this patent is extended or adjusted under 35 U.S.C. 154(b) by 178 days.

(21) Appl. No.: 13/346,836

(22) Filed: Jan. 10, 2012

(65) Prior Publication Data

US 2013/0176715 A1 Jul. 11, 2013

(51) Int. Cl.

| | |
|---|---|
| ***F21V 17/02*** | (2006.01) |
| ***F21V 17/10*** | (2006.01) |
| ***F21V 33/00*** | (2006.01) |
| ***F21L 4/04*** | (2006.01) |
| *F21V 21/096* | (2006.01) |

(52) U.S. Cl.

CPC ..... *F21V 17/02* (2013.01); *F21V 17/105* (2013.01); *F21V 33/00* (2013.01); *F21L 4/04* (2013.01); *F21V 21/096* (2013.01)

USPC ..... 362/139; 362/138; 362/142; 362/282; 362/198

(58) Field of Classification Search

USPC ..... 362/198, 162, 189, 120, 138–139, 142, 362/197, 398, 457; 359/221.2, 223.1, 359/226.1–226.2, 212.2, 871, 872, 903

See application file for complete search history.

(56) References Cited

U.S. PATENT DOCUMENTS

| | | | | |
|---|---|---|---|---|
| 3,924,115 | A | 12/1975 | Hampton et al. | |
| 4,225,907 | A * | 9/1980 | Erdell | 362/255 |
| 5,023,761 | A * | 6/1991 | de Lange | 362/120 |
| 5,176,438 | A | 1/1993 | Fisherman | |
| 5,381,319 | A | 1/1995 | Shiao | |
| 5,647,623 | A | 7/1997 | Shiao | |
| 5,707,137 | A | 1/1998 | Hon | |
| 5,716,121 | A | 2/1998 | Dubois | |
| 5,915,825 | A * | 6/1999 | Weister | 362/139 |
| 5,951,142 | A | 9/1999 | Wang et al. | |
| 6,007,214 | A * | 12/1999 | Shiao | 362/120 |
| 6,210,009 | B1 | 4/2001 | Daly | |
| 7,510,295 | B2 * | 3/2009 | Shih | 362/119 |
| 2003/0007346 | A1 | 1/2003 | Cooper et al. | |
| 2004/0090776 | A1 | 5/2004 | Yang | |
| 2005/0201085 | A1 | 9/2005 | Aikawa et al. | |

OTHER PUBLICATIONS

"Rite-Site Non-Inverted Image Inspection Mirror", product brochure by Sensible Products, Inc.

* cited by examiner

*Primary Examiner* — Diane Lee
*Assistant Examiner* — Kenny C Sokolowski
(74) *Attorney, Agent, or Firm* — Milton Gerstein

(57) ABSTRACT

A telescopic flashlight that includes a universally adjustable mirror unit for reflecting the light of the lighting unit over a universal range, which mirror unit is readily and easily attached and detached from the distal end of the flashlight apparatus via a metallic mounting collar that is magnetically retained by means of an annular magnet affixed to the distal end of the apparatus, which mounting collar itself is rotatable relative to the distal end of the flashlight apparatus in order to provide two of the three degrees of freedom on motion of the mirror proper.

17 Claims, 4 Drawing Sheets

MULTI-FUNCTION TELESCOPIC FLASHLIGHT WITH UNIVERSALLY-MOUNTED PIVOTAL MIRROR

BACKGROUND OF THE INVENTION

The present invention is directed to a telescopic flashlight, and, in particular, to such a telescopic flashlight disclosed in U.S. Pat. No. 7,510,295, which patent is incorporated by reference herein, and which discloses a telescopic, collapsing flashlight having an extensible stem with a retractable and bendable flexible member, which allows for hard-to-reach areas and locations to be illuminated. The illuminating structure or device of the flashlight is attached to, and located at, the distal end of the flexible member, and includes a power button. At the distal end of the illuminating body, there is also provided a magnetic collar for use in attracting and holding a metal object during use of the flashlight.

In U.S. Pat. No. 5,951,142 there is disclosed an adjustable illuminating apparatus having an adjustable lighting unit, and which is also provided with an adjustable reflecting mirror unit mounted at the end of the apparatus, with the light from the lighting unit impinging on the mirror and being reflected thereby. The reflecting mirror unit is mounted to the end of the apparatus via mating threaded parts.

In published U.S. Application Number US2005/0201085, there is disclosed a telescopic flashlight apparatus having at one end thereof a pivotal mirror unit for reflecting the light emanating from the lighting unit to various locations. This mirror unit is cumbersome, and difficult to attach and remove.

SUMMARY OF THE INVENTION

It is the primary objective of the present invention to provide a telescopic, collapsible flashlight apparatus that includes a universally adjustable inspection mirror unit for reflecting the light of the lighting unit over a universal range, which mirror unit is readily and easily attached and detached from the distal end of the flashlight apparatus via a mounting collar having an annular metallic mounting ring that is magnetically retained by means of an annular magnet affixed to the distal end of the apparatus where the lighting or illuminating device is located, which mounting collar itself is rotatable relative to the distal end of the flashlight apparatus in order to provide two degrees of freedom of rotational motion of the mirror proper.

It is also the primary objective of the present invention to provide such a telescopic flashlight apparatus with a distal, adjustable mirror unit that is itself removably detachable, such that the mirror proper may be attached and re-attached to the mounting collar at will, so that when the mirror proper is not needed for directing the light from the lighting unit to hard-to-see or get-at places or locations, it may be removed from the metallic mounting collar, so that it does not interfere with the normal and average use of the flashlight apparatus.

BRIEF DESCRIPTION OF THE DRAWING

The invention will be more readily understood with reference to the accompanying drawings, wherein.

DETAILED DESCRIPTION OF THE INVENTION

Figure 1:
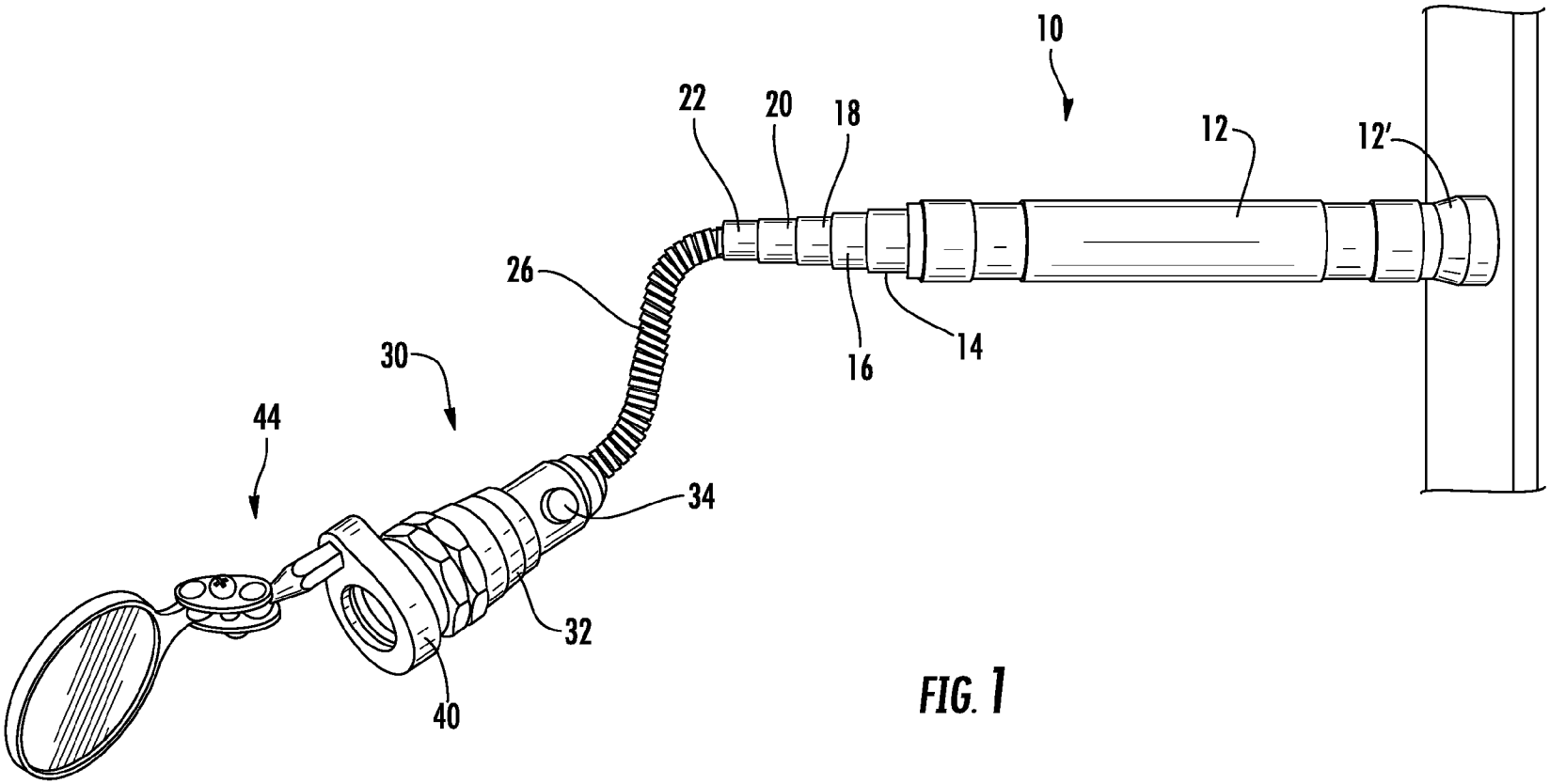
FIG. 1 is a perspective view of the telescopic flashlight device with universally-adjustable mirror unit of the invention.
Figure 2:
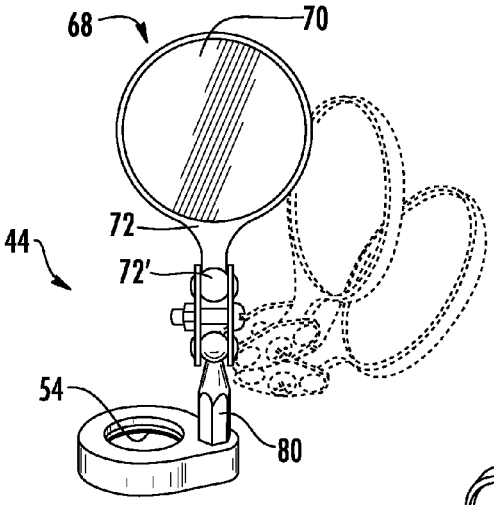
FIG. 2 is a perspective view of the universally-adjustable mirror unit of the flashlight device of FIG. 1 and showing various positions it may be assume in a first plane.
Figure 3:
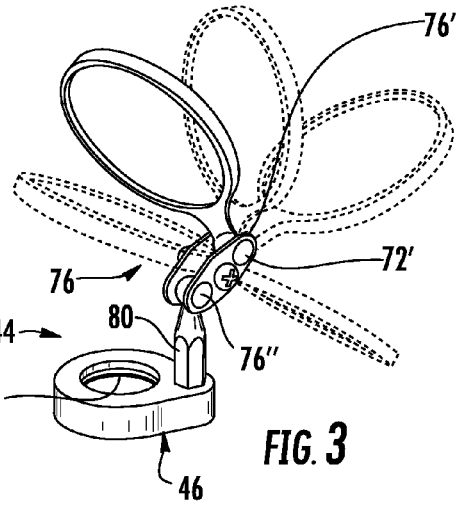
FIG. 3 is a perspective view similar to FIG. 3 but showing the universally-adjustable mirror unit pivoted to various positions via a first pivot in a second plane.
Figure 4:
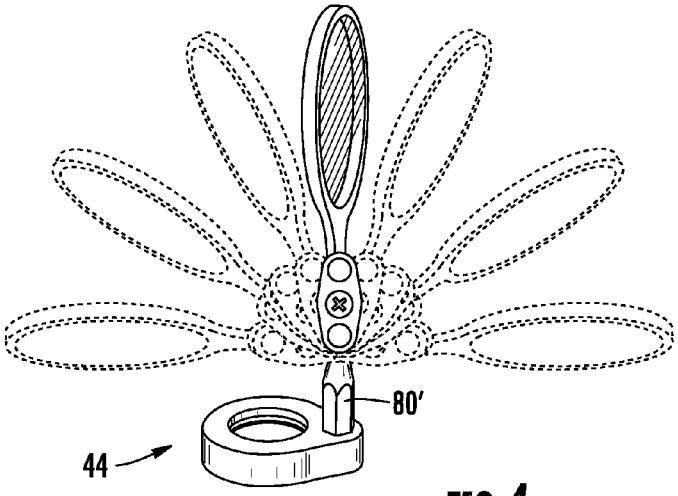
FIG. 4 is a perspective view similar to FIG. 3 but showing the universally-adjustable mirror unit pivoted to various positions via a second pivot in the second plane.

Referring now to the drawings in greater detail, the telescopic flashlight device with universally-adjustable mirror unit is indicated generally by reference numeral 10. The basic telescopic flashlight is that disclosed in U.S. Pat. No. 7,510,295, which patent is incorporated by reference herein. The telescopic, collapsing flashlight 10 includes a main, hollow, cylindrical handle, body portion or casing 12, used for gripping the flashlight, and in which is received a series of collapsing, hollow, telescoping elements or sections 14, 16, 18, 20, and 22. Each telescopic element 14, 16, 18, 20, and 22 is collapsible into the immediate-adjacent element closer to the main body portion or housing 12, in the manner depicted in FIG. 1, for storage, and for removal therefrom for expansion and use. The degree to which the telescoping elements are pulled out is variable so that the flashlight may be used in all environments. The end of the main body portion is provided with a enlarged head or section 12', to which is secured a magnet for attracting and holding metal objects.

Figure 5:
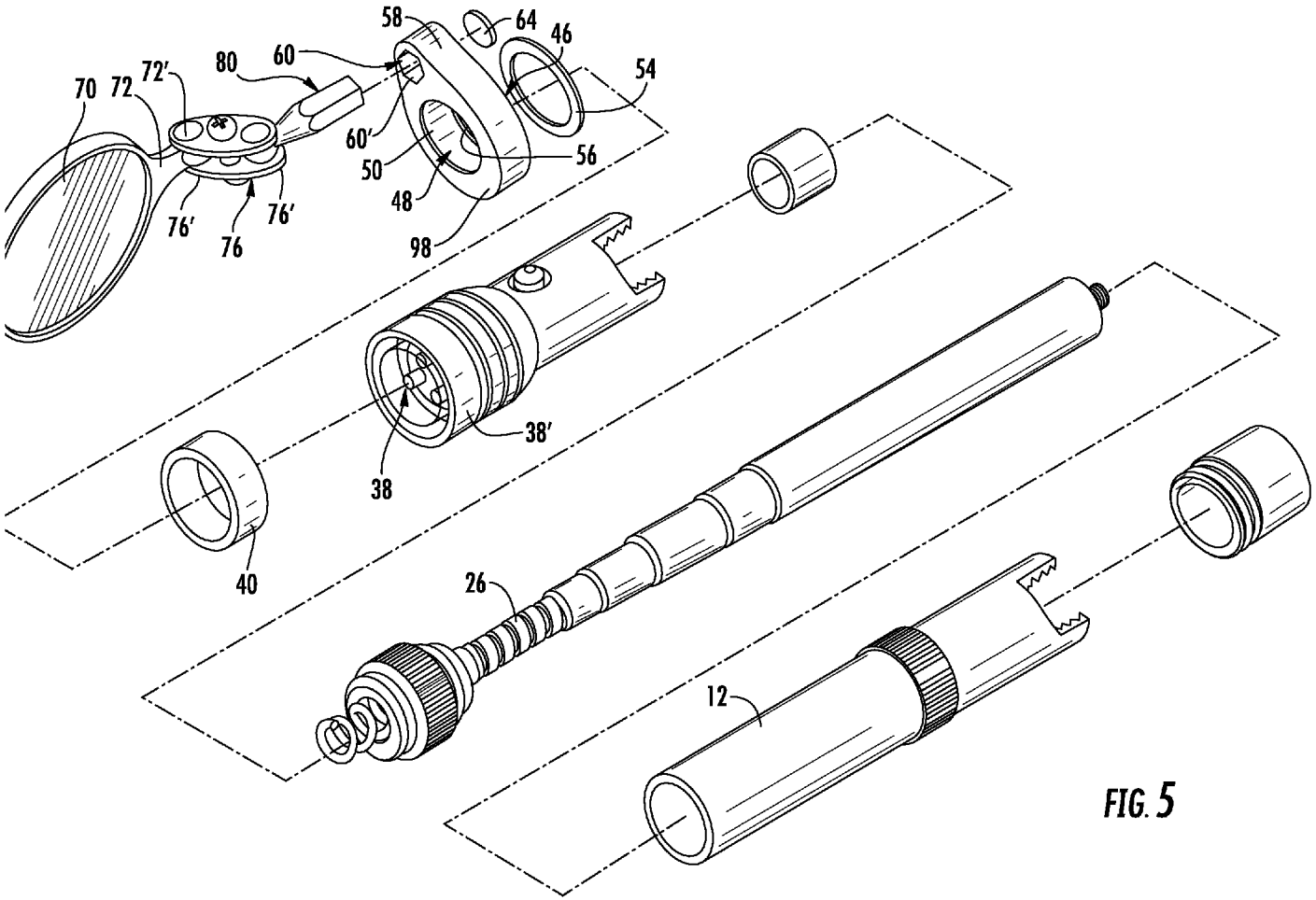
FIG. 5 is an assembly view, in perspective, showing the telescopic flashlight device with universally-adjustable mirror unit of FIG. 1.

At the end of the telescopic section 22 there is provided a flexible, bendable member or section 26 which is collapsible into the telescopic section 22, and to the end of which is attached or mounted an illuminating or lighting unit or device 30. The illuminating device 30 comprises a hollow main housing 32 serving as a battery or power-cell compartment, a push-button switch 34, or the equivalent thereof, and a removable bulb-fixture 38 (FIG. 5) containing one or more halogen lighting bulbs or LCD's. The distal end 38' of the removable bulb-fixture 38 also mounts a forwardly-facing, annular magnet, such as magnet-ring 40, by which objects may be picked up and held.

The annular magnet 40 is used to removably, temporarily and mutably mount a universally-pivotal reflection mirror unit 44. The universally-pivotal reflection mirror unit 44 is comprised of a removable mounting collar or annular ring-element 46, defining an inner, circular main portion 48 defining an exteriorly-located or outer annular surface section, which is substantially circular in shape that defines an outer or outwardly-facing opening 50. To the interior-facing portion of the exteriorly-located or outer annular surface section is mounted an annular element or ring 54 made of magnetic material, such as ferrous metal, which is attracted to, and held by the annular magnet 40. The inner or inwardly-facing opening 56 of the annular ring-element 46 has a diameter slightly larger than the diameter of the distal end of the removable bulb-fixture 38, so that the annular ring-element 46 may be telescopingly mounted thereover, and held removably in place thereat, by means of the annular magnet 40 magnetically retaining the annular ring-element 46 via the metallic ring or annular element 54, whereby the entire universally-pivotal reflection mirror unit 44 is rotatable in a first degree of rotational motion about the end of the flashlight. It is noted that the central or inner opening of the annular ring-element 46 has a diameter less than the diameter of the distal end of the removable bulb-fixture 38, whereby the interior-facing portion of the metallic annular ring 54 abuts against the annular end-surface distal end 38' of the removable bulb-fixture 38 in facto-face contact with the annular magnet 40 to allow for the mounting thereto. The material from which the annular ring element 46 is made is preferably plastic providing a low coefficient of friction, which readily allows the rotation thereof about the distal end 38' of the illuminating device 30, which is also made of plastic having a low coefficient of friction. The facing and contacting surfaces of the annular magnet 40 and the metallic annular ring 54 also offer a low coefficient of friction, whereby no obstruction to the rotation of the mounting annular ring-element 46 exists. Alternatively, the annular ring 46 may be made entirely of a low-coefficient-of-friction magnetic material, such as ferrous metal, which obviates the need for the metallic annular ring 54.

Figure 6:
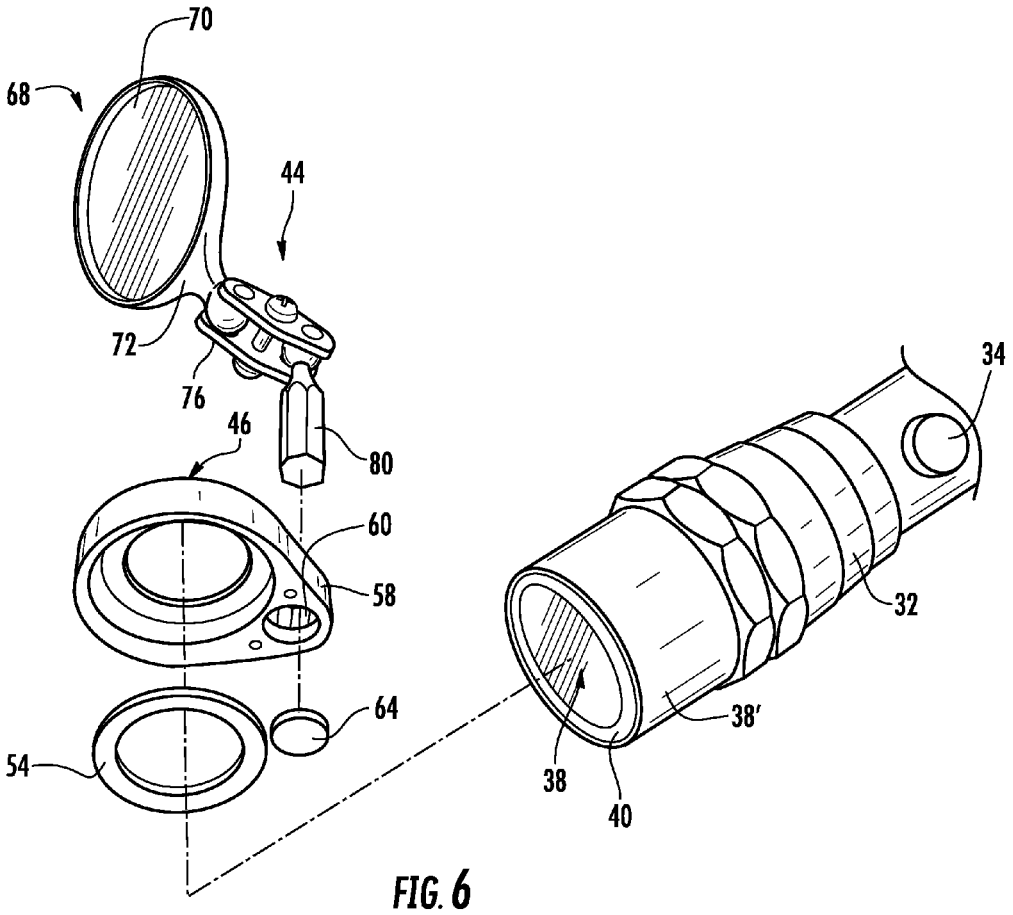
FIG. 6 is an assembly view of the universally-adjustable mirror unit of the invention.
Figure 7:
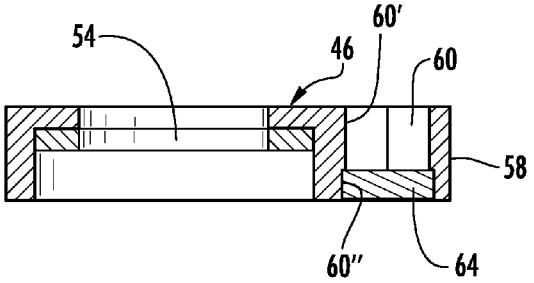
FIG. 7 is a transverse cross-sectional view of the assembled universally-adjustable mirror unit.

The removable mounting collar or annular ring-element 46 is also provided with an eccentric or protruding section 58 defining a through-opening or hole 60. The opening 60 has a first outer portion 60' that is preferably hexagonal in shape for part of the depth of the opening 60, and a second inner portion 60" that is circular in shape for the remainder of the depth thereof. Mounted in the circular portion 60" is a circularly-shaped magnetic rod or post-element 64, as best seen in FIGS. 6 and 7.

The universally-pivotal reflection mirror unit 44 also consists of the main mirror-portion 68, which contains the mirror-element proper 70, which is preferably circular in shape. The circular-shaped mirror 70 has a mounting eccentric or ear 72 defining a bottom pivot shaft or post 72' that is pivotally mounted at one end 76' of a mounting bracket 76, in a conventional manner; the mirror unit is allowed a second degree of rotational motion different from the first degree of rotational motion provided by the annular ring-element 46. To the other end 76" of the mounting bracket 76 is pivotally mounted a metallic mounting pin or shaft 80, made of ferrous metal or the like, which defines a hexagonally-shaped main shaft portion 80' which is partially receivable in the first, outer hexagonally-shaped portion 60' of the opening 60, whereby the metallic mounting pin or shaft 80, and thus the mirror-element proper 70, are removably mounted to the mounting collar or annular ring-element 46, and where the mirror unit is also allowed additional degrees of rotational motion via the spherical or ball joint at the upper end of the pin 80. Thus, the universally-pivotal reflection mirror unit 44 is removable from the illuminating or lighting unit or device 30 in two ways or sections. The first by means of the metallic collar, or an annular element or ring 46, by which the entire mirror unit 44 is removable, and the second by means of the metallic mounting pin or shaft 80, by which part of the mirror unit 44 is removable, whereby differently-shaped or sized mirrors 70 may be mounted to the illuminating device. For example, a prism mirror, disclosed in U.S. Pat. No. 6,210,009, may be attached to the illuminating apparatus, which prism mirror displays a non-inverted image of the object or objects, being viewed in the proper sense and handedness.

While the universally-pivotal reflection mirror unit 44 has been disclosed for use and removable attachment to a telescopic, collapsing flashlight, it may be used in all types of flashlights incorporating an annular magnet at the distal end of the lighting unit itself, or at the distal of another section of the flashlight. Moreover, the universally-pivotal reflection mirror unit 44 may incorporated into other lighting devices not considered to be a flashlight, as long as it incorporates a magnetic ring or magnetic, in a manner equivalent to the mounting of the universally-pivotal reflection mirror unit 44.

It is also noted that instead of the forwardly-facing annular magnet 40 located on the front surface of the illuminating device 30, a collar-magnet that circumferentially surrounds the end 38' thereof may be used, in which case the annular element or ring 46 would be located or mounted to interior annular rim-surface thereof for face-to-face contact with the collar-magnet.

While a specific embodiment of the invention has been shown and described, it is to be understood that numerous changes and modifications may be made therein without departing from the scope and spirit of the invention.

What is claimed is:

1. A universally-adjustable inspection mirror apparatus for removable attachment to a magnet mounted at an outer end portion of an illuminating apparatus for providing rotational movement to the mirror apparatus, said mirror apparatus comprising:

a mounting bracket comprising an annular collar element defining a first inner opening for positioning circumferentially about the outer portion of the illuminating apparatus, and a second, smaller outer opening defining an interior annular rim, and a mirror device connected to said mounting bracket; said mounting bracket mounting said mirror apparatus for rotatable movement about the outer end portion of the illuminating apparatus;

said mirror device comprising a mirror, a first pivotal mounting element having a first end for mounting said mirror for pivotal motion in a first plane perpendicular to a plane in which said mounting bracket allows rotation, and a second end; and a second mounting element having a first end pivotally mounted in said second end of said first mounting element, and a second end connected to said mounting bracket for allowing pivotal movement of said mirror in a second plane parallel to said first plane;

said mounting bracket comprising an annular mounting ring made of magnetic material mounted to the interior surface of said annular rim.

2. The universally-adjustable mirror apparatus according to claim 1, wherein said mounting bracket comprises a hole, and another magnet partially received in said hole; said second end of said second mounting element being detachably received in said hole of said mounting bracket in close juxtaposition to said another magnet mounted in said hole, whereby said second mounting element is removably held in place by said another magnet, and whereby parts of said mirror apparatus are removable from the illuminating apparatus in two distinct ways.

3. The universally-adjustable mirror apparatus according to claim 2, wherein said hole comprises a first circular section for receiving and mounting therein said another magnet, and a second section of non-circular cross section for receiving said second end of said second mounting element therein; said second end of said second mounting element having the same cross-sectional shape as said second section of said opening.

4. The universally-adjustable mirror apparatus according to claim 1, wherein said mounting bracket comprises an eccentric section projecting from a portion of said annular collar element, and a hole located in said eccentric section.

5. The universally-adjustable mirror apparatus according to claim 1, in combination with the illuminating apparatus, said illuminating apparatus comprising:

a collapsing, telescoping flashlight comprising a main, hollow, handle portion, and a plurality of telescoping sections collapsible one in another and into said main, hollow, handle portion, at least one of the telescoping sections being a flexible and bendable section and defining a distal end, and an illuminating device mounted to said distal end of said flexible and bendable section, said illuminating device having the outer end portion thereof distant from said telescoping sections, and the magnet mounted at said outer end portion of said illuminating device; said mounting bracket being detachably connected to said outer end portion of said illuminating device via said magnet and said annular mounting ring made of magnetic material.

6. The universally-adjustable mirror apparatus according to claim 1, in combination with the illuminating apparatus, said illuminating apparatus comprising:

a main housing, and an illuminating device mounted to said main housing; said illuminating device having the outer portion thereof, and the magnet mounted at said outer end portion of said illuminating device; said mounting bracket being detachably connected to said outer end portion of said illuminating device via said magnet and said annular mounting ring made of magnetic material.

7. A universally-adjustable inspection mirror apparatus for removable attachment to a magnet mounted at an outer end portion of an illuminating apparatus for providing rotational movement to the mirror apparatus, said mirror apparatus comprising:

a mounting bracket comprising an annular collar element defining a first inner opening for positioning circumferentially about the outer end portion of the illuminating apparatus, and a second, smaller outer opening defining an interior annular rim, and a mirror device connected to said mounting bracket; said mounting bracket mounting said mirror apparatus for rotatable movement about the outer end portion of the illuminating apparatus;

said mirror device comprising a mirror, a first pivotal mounting element having a first end for mounting said mirror for pivotal motion in a first plane perpendicular to a plane in which said mounting bracket allows rotation, and a second end; and a second mounting element having a first end mounted in said second end of said first mounting element, and a second end connected to said mounting bracket;

said mounting bracket comprising an annular mounting ring made of magnetic material mounted to the interior surface of said annular rim.

8. The universally-adjustable mirror apparatus according to claim 7, wherein said first end of said second mounting element is pivotally connected to said second end of said first mounting element for allowing additional pivotal movement of said mirror in a second plane parallel to said first plane.

9. The universally-adjustable mirror apparatus according to claim 7, wherein said mounting bracket comprises a hole, and another magnet partially received in said hole; said second end of said second mounting element being detachably received in said hole of said mounting bracket in close juxtaposition to said another magnet mounted in said hole, whereby said second mounting element is removably held in place by said another magnet, and whereby parts of said mirror apparatus are removable from the illuminating apparatus in two distinct ways.

10. The universally-adjustable mirror apparatus according to claim 9, wherein said hole comprises a first circular section for receiving and mounting therein said another magnet, and a second section of non-circular cross section for receiving said second end of said second mounting element therein; said second end of said second mounting element having the same cross-sectional shape as said second section of said opening.

11. The universally-adjustable mirror apparatus according to claim 7, wherein said mounting bracket comprises an eccentric section projecting from a portion of said annular collar element, and a hole located in said eccentric section.

12. The universally-adjustable mirror apparatus according to claim 7, in combination with the illuminating apparatus, said illuminating apparatus comprising:

a collapsing, telescoping flashlight comprising a main, hollow, handle portion, and a plurality of telescoping sections collapsible one in another and into said main, hollow, handle portion, at least one of the telescoping sections being a flexible and bendable section and defining a distal end, and an illuminating device mounted to said distal end of said flexible and bendable section, said illuminating device having the outer end portion thereof distant from said telescoping sections, and the magnet mounted at said outer end portion of said illuminating device; said mounting bracket being detachably connected to said outer end portion of said illuminating device via said magnet and said annular mounting ring made of magnetic material.

13. A universally-adjustable inspection mirror apparatus for removable attachment to a magnet mounted at an outer end portion of an illuminating apparatus for providing rotational movement to the mirror apparatus, said mirror apparatus comprising:

a mounting bracket comprising an annular collar element defining a first inner opening for positioning circumferentially about the outer end portion of the illuminating apparatus, and a second, smaller outer opening defining an interior annular rim, and a mirror device connected to said mounting bracket; said mounting bracket mounting said mirror device for rotatable movement about the outer end portion of the illuminating apparatus;

said mirror device comprising a mirror; a first mounting element having a first end for mounting said mirror, and a second end; and a second pivotal mounting element having a first end pivotally mounted in said second end of said first mounting element, and a second end connected to said mounting bracket;

said mounting bracket comprising an annular mounting ring made of magnetic material mounted to the interior surface of said annular rim.

14. The universally-adjustable mirror apparatus according to claim 13, wherein said mounting bracket comprises a hole, and another magnet partially received in said hole; said second end of said second pivotal mounting element being detachably received in said hole of said mounting bracket in close juxtaposition to said another magnet mounted in said hole, whereby said second pivotal mounting element is removably held in place by said another magnet, and whereby parts of said mirror apparatus are removable from the illuminating device in two distinct ways.

15. The universally-adjustable mirror apparatus according to claim 14, wherein said hole comprises a first circular section for receiving and mounting therein said another magnet, and a second section of non-circular cross section for receiving said second end of said second pivotal mounting element therein; said second end of said second pivotal mounting element having the same cross-sectional shape as said second section of said opening.

16. The universally-adjustable mirror apparatus according to claim 14, wherein said mounting bracket comprises an eccentric section projecting from a portion of said annular collar element, said hole of said mounting bracket being located in said eccentric section.

17. The universally-adjustable mirror apparatus according to claim 13, in combination with the illuminating apparatus, said illuminating apparatus comprising:

a collapsing, telescoping flashlight comprising a main, hollow, handle portion, and a plurality of telescoping sections collapsible one in another and into said main, hollow, handle portion, at least one of the telescoping sections being a flexible and bendable section and defining a distal end and an illuminating device mounted to said distal end of said flexible and bendable section, said illuminating device having the outer end portion thereof distant from said telescoping sections, and the magnet mounted at said outer end portion of said illuminating device; said mounting bracket being detachably connected to said outer end portion of said illuminating device via said magnet and said annular mounting ring made of magnetic material.

* * * * *